US006886540B2

(12) United States Patent
Suzuki et al.

(10) Patent No.: US 6,886,540 B2
(45) Date of Patent: May 3, 2005

(54) SENSOR ARRANGEMENT FOR ENGINE

(75) Inventors: Masaru Suzuki, Shizuoka (JP); Hitoshi Watanabe, Shizuoka (JP)

(73) Assignee: Yamaha Marine Kabushiki Kaisha, Hamamatsu (JP)

( * ) Notice: Subject to any disclaimer, the term of this patent is extended or adjusted under 35 U.S.C. 154(b) by 188 days.

(21) Appl. No.: 09/906,389

(22) Filed: Jul. 16, 2001

(65) Prior Publication Data

US 2002/0043252 A1 Apr. 18, 2002

(30) Foreign Application Priority Data

Jul. 14, 2000 (JP) ..... 2000-215161

(51) Int. Cl.[7] ..... F02M 51/00
(52) U.S. Cl. ..... 123/478; 123/480; 123/350
(58) Field of Search ..... 123/478, 480, 123/494, 497, 350, 376

(56) References Cited

U.S. PATENT DOCUMENTS

| | | | | |
|---|---|---|---|---|
| 4,010,717 A | | 3/1977 | Taplin | |
| 4,412,520 A | | 11/1983 | Mitsuyasu et al. | |
| 4,413,602 A | | 11/1983 | Inoue et al. | |
| 4,546,746 A | * | 10/1985 | Sato et al. | 123/478 |
| 4,930,482 A | | 6/1990 | Kako | |
| 4,936,278 A | | 6/1990 | Umeda | |

(Continued)

FOREIGN PATENT DOCUMENTS

| | | |
|---|---|---|
| JP | 9-088623 | 3/1997 |
| JP | 9-324713 | 12/1997 |
| JP | 2000-186653 | 7/2000 |
| JP | 2000-192831 | 7/2000 |

OTHER PUBLICATIONS

Yamaha F115A and FL115Y Service Manual, 1st edition, Jan. 2000, cover page and pp. 8–1, 8–5, published by Yamaha Motor Co., Ltd.

Chowanietz, Eric, *Automobile Electronics*, Copyright 1995, pp. 109–112, published by Society of Automotive Engineers, Inc.

*Primary Examiner*—John T. Kwon
(74) *Attorney, Agent, or Firm*—Knobbe, Martens, Olson & Bear, LLP

(57) ABSTRACT

An engine includes an improved sensor arrangement that can decrease the possibility of damage to sensors relating to fuel injection control. The engine includes a cylinder block defining first and second banks of cylinder bores extending separately from each other. Pistons reciprocate within the respective cylinder bores. Cylinder head members are arranged to close respective ends of the first and second banks of the cylinder bores. The cylinder head members define combustion chambers together with the cylinder bores and the pistons. An air induction system is arranged to introduce air to the combustion chambers. The induction system includes first and second intake units with the first intake unit allotted to the first cylinder bank and with the second intake unit allotted to the second cylinder bank. The first and second intake units define first and second intake passages, respectively, through which the air flows. Fuel injectors are arranged to spray fuel for combustion in the combustion chambers. First and second sensors are arranged to sense a condition of the intake air. A control device is configured to control the fuel injectors based upon signals of the first and second sensors. The first sensor is disposed at the first intake unit. The second sensor is disposed at the second intake unit.

23 Claims, 3 Drawing Sheets

U.S. PATENT DOCUMENTS 5,241,939 A 9/1993 Nonaka
5,579,736 A 12/1996 Nakamura et al.
5,579,745 A 12/1996 Katoh et al.
5,584,281 A 12/1996 Katoh
5,586,524 A 12/1996 Nonaka et al.
5,673,676 A 10/1997 Mukumoto
5,694,909 A 12/1997 Kato
5,704,334 A 1/1998 Kato
5,709,198 A 1/1998 Sagisaka et al.
5,711,148 A 1/1998 Katoh
5,712,422 A 1/1998 Kato
5,724,951 A 3/1998 Mukumoto
5,727,536 A 3/1998 Kato
5,762,053 A 6/1998 Anamoto
5,813,390 A 9/1998 Anamoto
5,829,402 A 11/1998 Takahashi et al.
5,832,907 A 11/1998 Kato
5,873,347 A 2/1999 Kato et al.
5,911,610 A 6/1999 Fujimoto
5,915,363 A 6/1999 Iwata et al.
5,918,275 A 6/1999 Kato et al.
5,918,584 A 7/1999 Kato
5,921,220 A 7/1999 Kato
5,924,409 A 7/1999 Kato
5,937,825 A 8/1999 Motose
5,941,223 A 8/1999 Kato
5,957,108 A 9/1999 Kato
5,983,878 A 11/1999 Nonaka et al.
6,015,319 A 1/2000 Tanaka
6,041,758 A 3/2000 Ishii
6,067,956 A 5/2000 Motose et al.
6,067,957 A 5/2000 Motose et al.
6,116,228 A 9/2000 Motose et al.
6,119,453 A 9/2000 Motose et al.
6,135,095 A 10/2000 Motose et al.
6,227,172 B1 5/2001 Katayama et al.
6,279,372 B1 8/2001 Zhang
6,286,492 B1 9/2001 Kanno

* cited by examiner

SENSOR ARRANGEMENT FOR ENGINE

PRIORITY INFORMATION

This application is based on and claims priority to Japanese Patent Application No. 2000-215161, filed Jul. 14, 2000, the entire contents of which is hereby expressly incorporated by reference.

BACKGROUND OF THE INVENTION

1. Field of the Invention

The present invention relates generally to a sensor arrangement for an engine, and more particularly to an improved sensor arrangement for a split-bank, multicylinder engine.

2. Description of Related Art

In all fields of engine design, there is increasing emphasis on obtaining high performance in output and more effective emission control. This trend has resulted in employing, for example, a fuel injected, multi-cylinder, four-cycle engine. The engine can have a direct or indirect fuel injection system and multiple cylinders such as, for example, six cylinders arranged in V-configuration. The fuel injection system enables the engine to be more responsive to operator demand, which may rapidly change. For example, the operator may desire that the engine rapidly accelerate and then rapidly decelerate within a short period of time. Fuel injection is an advantageous manner to achieve fuel economy and responsiveness under such engine operating conditions.

The fuel injection system and other sophisticated electrical devices associated with the engine require a high performance control system, which can include a control unit such as, for example, an electronic control unit (ECU), and various sensors that can sense the operator's demands and surrounding conditions; both of which can rapidly change. Sensors may be employed that sense a condition of intake air within the intake passages to detect the operator's demands and the proper amount of fuel for injection. Several sensors are available for this purpose.

An intake air pressure sensor is one such sense. The pressure sensor senses an intake air pressure within the intake passages. The signal sensed by the intake pressure sensor is highly important to determining a proper amount of fuel for injection. Engine speed is also important to this analysis. A crankshaft angle position sensor can be used to sense engine speed. In addition, a throttle valve position sensor is another important sensor in evaluating operator demands. The throttle valves typically are operable by the operator to control the engine speed or torque of the engine. That is, the opening degree of the throttle valves can vary in response to a movement of a throttle lever which can be operated by the operator when he or she desires to accelerate or decelerate the engine operation. The signal sensed by the throttle valve position sensor can be used for increasing or decreasing the injected fuel amount in response to the acceleration demand or deceleration demand, respectively. For example, JP Laid Open No. 9-88623 (corresponding to U.S. Pat. No. 5,829,402) discloses such an intake air pressure sensor (50) and an throttle valve position sensor (57).

With the V-configured, multi-cylinder, four-cycle engine, all of the intake air relating sensors typically are arranged on the intake conduits on a single side so that maintenance service can be more easily performed. This arrangement, however, increases the possibility of damage to all of the related sensors when something damages a portion of the engine on this side. The problem is serious with outboard motors, which of course can employ such an engine, because a cowling assembly made of plastic typically is the only protection for the engine.

A need therefore exists for an improved sensor arrangement for an engine that can decrease possibility of damage to all of the sensors that sense a condition of intake air.

SUMMARY OF THE INVENTION

In accordance with one aspect of the present invention, an internal combustion engine comprises a cylinder block defining first and second banks of cylinder bores extending separately from each other. Pistons reciprocate within the respective cylinder bores. Cylinder head members are arranged to close respective ends of the first and second banks of the cylinder bores. The cylinder head members define combustion chambers together with the cylinder bores and the pistons. An air induction system is arranged to introduce air to the combustion chambers. The induction system includes first and second intake units with the first intake unit allotted to the first cylinder bank and with the second intake unit allotted to the second cylinder bank. The first and second intake units define first and second intake passages, respectively, through which the air flows. Fuel injectors are arranged to spray fuel for combustion in the combustion chambers. First and second sensors are arranged to sense a condition of the intake air. A control device is configured to control the fuel injectors based upon signals of the first and second sensors. The first sensor is disposed at the first intake unit. The second sensor is disposed at the second intake unit.

In accordance with another aspect of the present invention, an outboard motor comprises an internal combustion engine. A support member is arranged to support the engine. The engine includes an engine body. At least two moveable members are moveable relative to the engine body. The engine body and the moveable members together define at least two combustion chambers. An air induction system is arranged to introduce air to the combustion chambers. The induction system includes first and second intake units delivering the air to the respective combustion chambers. At least one electrical device relates to the operation of the engine. First and second sensors are arranged to sense a condition of the intake air. A control device is configured to control the electrical device based upon signals of the first and second sensors. The first sensor is disposed at the first intake unit. The second sensor is disposed at the second intake unit.

BRIEF DESCRIPTION OF THE DRAWINGS

These and other features, aspects and advantages of the present invention will now be described with reference to the drawings of a preferred embodiment which is intended to illustrate and not to limit the invention. The drawings comprise three figures.

DETAILED DESCRIPTION OF THE PREFERRED EMBODIMENT OF THE INVENTION

Figure 1:
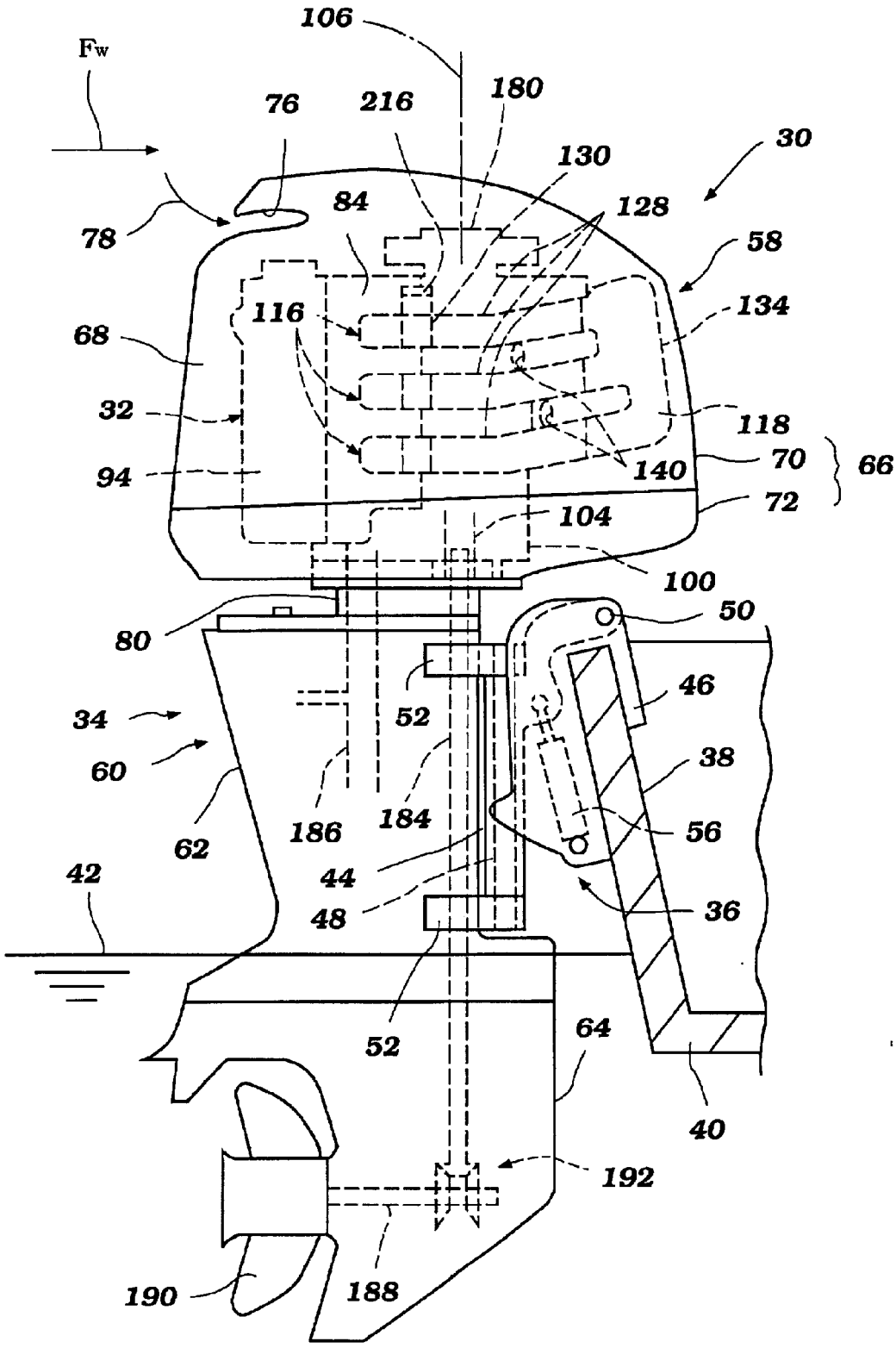
FIG. 1 is a side elevational view of an outboard motor configured in accordance with a preferred embodiment of the present invention. An associated watercraft is partially shown in section.
Figure 2:
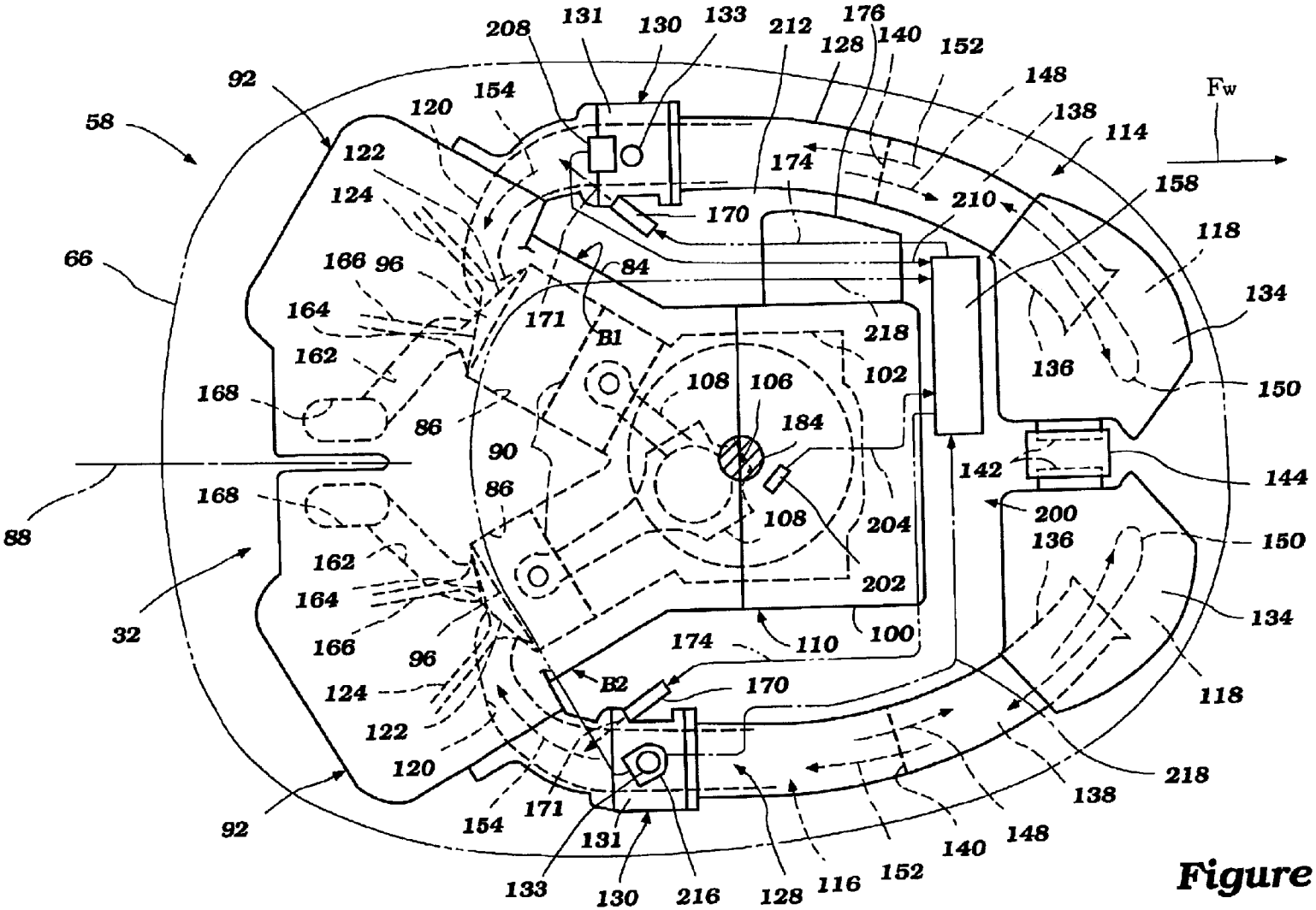
FIG. 2 is a top plan view of an engine of the outboard motor. A protective cowling is shown in phantom line.
Figure 3:
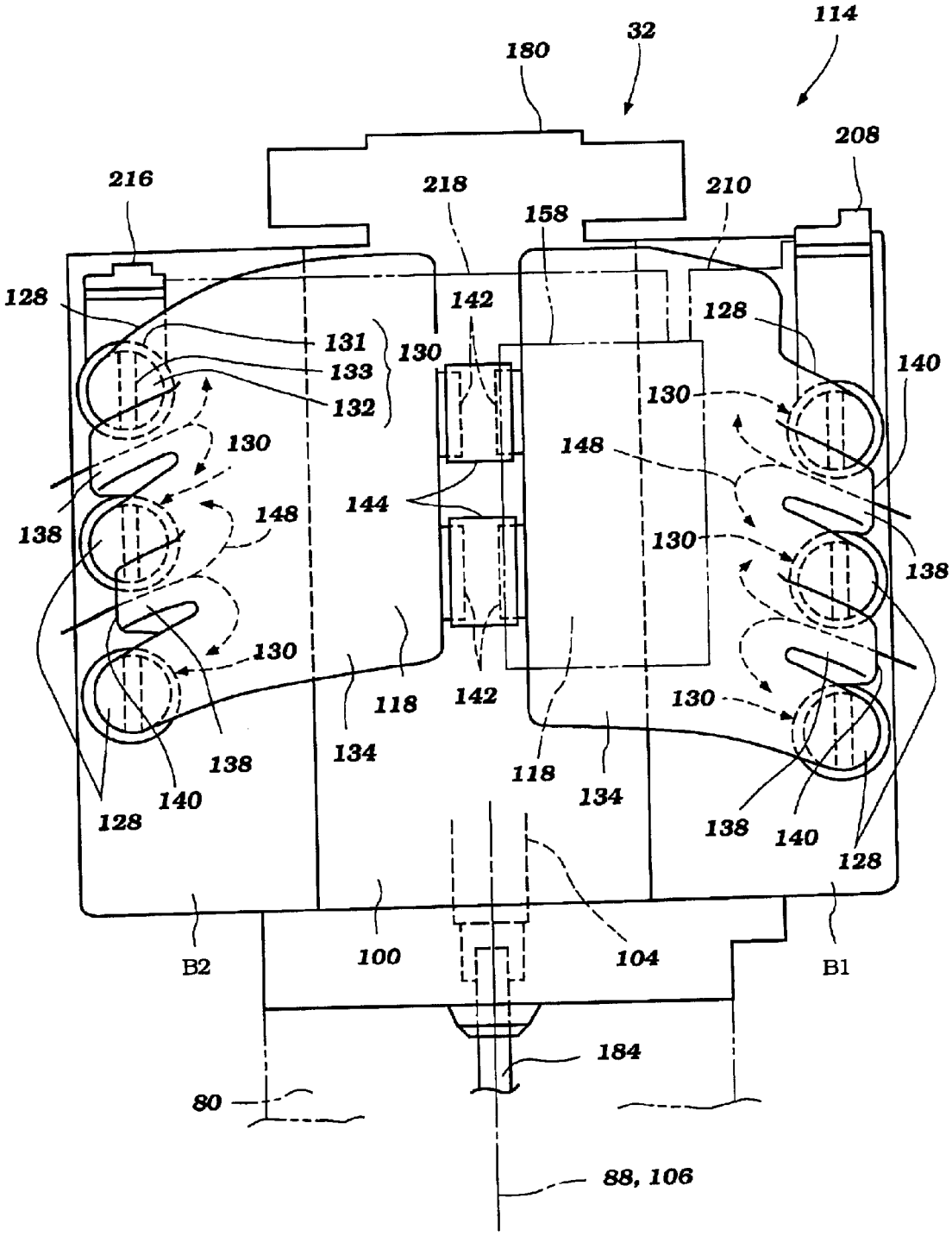
FIG. 3 is a front view of the engine with an exhaust guide member. The exhaust guide member is partially shown in phantom line.

With reference to FIGS. 1–3, an overall construction of an outboard motor 30 that employs an internal combustion engine 32 configured in accordance with certain features, aspects and advantages of the present invention will be described. The engine 32 has particular utility in the context of a marine drive, such as the outboard motor 30 for instance, and thus is described in the context of an outboard motor. The engine 32, however, can be used with other types of marine drives (i.e., inboard motors, inboard/outboard motors, etc.) and also certain land vehicles, which includes lawnmowers, motorcycles, go carts, all terrain vehicles and the like. Furthermore, the engine 32 can be used as a stationary engine for some applications that will become apparent to those of ordinary skill in the art.

In the illustrated arrangement, the outboard motor 30 generally comprises a drive unit 34 and a bracket assembly 36. The bracket assembly 36 supports the drive unit 34 on a transom 38 of an associated watercraft 40 and places a marine propulsion device in a submerged position with the watercraft 40 resting relative to a surface 42 of a body of water. The bracket assembly 36 preferably comprises a swivel bracket 44, a clamping bracket 46, a steering shaft 48 and a pivot pin 50.

The steering shaft 48 typically extends through the swivel bracket 44 and is affixed to the drive unit 34 by top and bottom mount assemblies 52. The steering shaft 48 is pivotally journaled for steering movement about a generally vertically extending steering axis defined within the swivel bracket 44. The clamping bracket 46 comprises a pair of bracket arms that preferably are laterally spaced apart from each other and that are attached to the watercraft transom 38.

The pivot pin 50 completes a hinge coupling between the swivel bracket 44 and the clamping bracket 46. The pivot pin 50 preferably extends through the bracket arms so that the clamping bracket 46 supports the swivel bracket 44 for pivotal movement about a generally horizontally extending tilt axis defined by the pivot pin 50. The drive unit 34 thus can be tilted or trimmed about the pivot pin 50.

As used through this description, the terms "forward," "forwardly" and "front" mean at or to the side where the bracket assembly 36 is located, unless indicated otherwise or otherwise readily apparent from the context use. The arrows Fw of FIGS. 1, 2, 5, 6 and 8 indicate the forward direction. The terms "rear," "reverse," "backwardly" and "rearwardly" mean at or to the opposite side of the front side.

A hydraulic tilt and trim adjustment system 56 preferably is provided between the swivel bracket 44 and the clamping bracket 46 for tilt movement (raising or lowering) of the swivel bracket 44 and the drive unit 34 relative to the clamping bracket 46. Otherwise, the outboard motor 30 can have a manually operated system for tilting the drive unit 34. Typically, the term "tilt movement", when used in a broad sense, comprises both a tilt movement and a trim adjustment movement.

The illustrated drive unit 34 comprises a power head 58 and a housing unit 60, which includes a driveshaft housing 62 and a lower unit 64. The power head 58 is disposed atop the housing unit 60 and includes an internal combustion engine 32 that is positioned within a protective cowling assembly 66, which preferably is made of plastic. In most arrangements, the protective cowling assembly 66 defines a generally closed cavity 68 in which the engine 32 is disposed. The engine, thus, is generally protected from environmental elements within the enclosure defined by the cowling assembly 66.

The protective cowling assembly 66 preferably comprises a top cowling member 70 and a bottom cowling member 72. The top cowling member 70 preferably is detachably affixed to the bottom cowling member 72 by a coupling mechanism so that a user, operator, mechanic or repairperson can access the engine 32 for maintenance or for other purposes. In some arrangements, the top cowling member 70 is hingedly attached to the bottom member such that the top cowling member 70 can be pivoted away from the bottom cowling member for access to the engine. Preferably, such a pivoting allows the top cowling member to be pivoted about the rear end of the outboard motor, which facilitates access to the engine from within the associated watercraft 40.

The top cowling member 70 preferably has a rear intake opening 76 defined through an upper rear portion. A rear intake member with one or more air ducts is unitarily formed with or is affixed to the top cowling member 70. The rear intake member, together with the upper rear portion of the top cowling member 70, generally defines a rear air intake space. Ambient air is drawn into the closed cavity 68 via the rear intake opening 76 and the air ducts of the rear intake member as indicated by the arrow 78 of FIG. 1. Typically, the top cowling member 70 tapers in girth toward its top surface, which is in the general proximity of the air intake opening 76. The taper helps to reduce the lateral dimension of the outboard motor, which helps to reduce the air drag on the watercraft during movement.

The bottom cowling member 72 preferably has an opening through which an upper portion of an exhaust guide member or support member 80 extends. The exhaust guide member 80 preferably is made of aluminum alloy and is affixed atop the driveshaft housing 62. The bottom cowling member 72 and the exhaust guide member 80 together generally form a tray. The engine 32 is placed onto this tray and can be affixed to the exhaust guide member 80. The exhaust guide member 80 also defines an exhaust discharge passage through which burnt charges (e.g., exhaust gases) from the engine 32 pass.

The engine 32 in the illustrated embodiment preferably operates on a four-cycle combustion principle. With reference now to FIG. 2, the presently preferred engine 32 has a cylinder block 84 configured as a V shape. The cylinder block 84 thus defines two cylinder banks B1, B2 which extend side by side with each other. In the illustrated arrangement, the cylinder bank B1 is disposed on the port side, while the cylinder bank B2 is disposed on the starboard side. In the illustrated arrangement, each cylinder bank B1, B2 has three cylinder bores 86 such that the cylinder block 84 has six cylinder bores 86 in total. The cylinder bores 86 of each bank B1, B2 extend generally horizontally and are generally vertically spaced from one another. As used in this description, the term "horizontally" means that the subject portions, members or components extend generally in parallel to the water surface 42 (i.e., generally normal to the direction of gravity) when the associated watercraft 40 is substantially stationary with respect to the water surface 42 and when the drive unit 34 is not tilted (i.e., is placed in the position shown in FIG. 1). The term "vertically" in turn means that portions, members or components extend generally normal to those that extend horizontally.

The illustrated engine 32 generally is symmetrical about a longitudinal center plane 88 that extends generally vertically and fore to aft of the outboard motor 30. This type of engine, however, merely exemplifies one type of engine on which various aspects and features of the present invention can be suitably used. Preferably, the engine has at least two cylinder banks which extend separately of each other. For instance, an engine having an opposing cylinder arrangement can use certain features of the present invention. Nevertheless, engines having other numbers of cylinders, having other cylinder arrangements (in-line, opposing, etc.), and operating on other combustion principles (e.g., crankcase compression two-stroke or rotary) also can employ various features, aspects and advantages of the present invention. In addition, the engine can be formed with separate cylinder bodies rather than a number of cylinder bores formed in a cylinder block. Regardless of the particular construction, the engine preferably comprises an engine body that includes at least one cylinder bore.

A moveable member, such as a reciprocating piston 90, moves relative to the cylinder block 84 in a suitable manner. In the illustrated arrangement, a piston 90 reciprocates within each cylinder bore 86.

Because the cylinder block 84 is split into the two cylinder banks B1, B2, each cylinder bank B1, B2 extends outward at an angle to an independent first end in the illustrated arrangement. A pair of cylinder head assemblies or members 92 are affixed to the respective ends of the cylinder banks B1, B2 to close the ends of the cylinder bores. The cylinder head assemblies 92, together with the associated pistons 90 and cylinder bores 86, preferably define six combustion chambers 96. Of course, the number of combustion chambers can vary, as indicated above.

A crankcase member 100 closes the other end of the cylinder bores 86 and, together with the cylinder block 84, defines a crankcase chamber 102. A crankshaft 104 extends generally vertically through the crankcase chamber 102 and can be journaled for rotation about a rotational axis 106 by several bearing blocks. The rotational axis 106 of the crankshaft 104 preferably is on the longitudinal center plane 88. Connecting rods 108 couple the crankshaft 104 with the respective pistons 90 in any suitable manner. Thus, the reciprocal movement of the pistons 90 rotates the crankshaft 104.

Preferably, the crankcase member 100 is located at the forwardmost position of the engine 32, with the cylinder block 84 and the cylinder head assemblies 92 being disposed rearward from the crankcase member 100, one after another. Generally, the cylinder block 84 (or individual cylinder bodies), the cylinder head assemblies 92 and the crankcase member 100 together define an engine body 110. Preferably, at least these major engine portions 84, 92, 100 are made of aluminum alloy. The aluminum alloy advantageously increases strength over cast iron while decreasing the weight of the engine body 110.

The engine 32 also comprises an air induction system 114. The air induction system 114 draws air from within the cavity 68 to the combustion chambers 96. The air induction system 114 preferably comprises six intake passages 116 and a pair of plenum chambers 118. In the illustrated arrangement, each cylinder bank B1, B2 is allotted with three intake passages 116 and one plenum chamber 118.

The most-downstream portions of the intake passages 116 are defined within the cylinder head assemblies 92 as inner intake passages 120. The inner intake passages 120 communicate with the combustion chambers 96 through intake ports 122, which are formed at inner surfaces of the cylinder head assemblies 92. Typically, each of the combustion chambers 96 has one or more intake ports 122. Intake valves 124 are slidably disposed at each cylinder head assembly 92 to move between an open position and a closed position. As such, the valves 124 act to open and close the ports 122 to control the flow of air into the combustion chamber 96. Biasing members, such as springs, are used to urge the intake valves 124 toward the respective closed positions by acting between a mounting boss formed on each cylinder head assembly 92 and a corresponding retainer that is affixed to each of the valves 124. When each intake valve 124 is in the open position, the inner intake passage 120 that is associated with the intake port 122 communicates with the associated combustion chamber 96.

Outer portions of the intake passages 116, which are disposed outside of the cylinder head assemblies 92, preferably are defined with intake conduits 128. The intake conduits on one side form an intake unit. The illustrated induction system 114, thus, has a pair of intake units, each of which comprises three intake conduits 128. It should be noted that the induction system can have only one intake conduit, i.e., a single intake passage, one each side.

Each intake conduit 128 includes a control mechanism or throttle valve assembly 130. In the illustrated arrangement, the intake conduit 128 is formed with two pieces with the throttle valve assembly 130 being positioned therebetween. While the intake conduits 128 allotted to the cylinder bank B1 extend forwardly along a side surface of the engine body 110 on the port side from the cylinder head assembly 92 to the front of the crankcase member 100, the intake conduits 128 allotted to the cylinder bank B2 extend forwardly along a side surface of the engine body 110 on the starboard side from the cylinder head assembly 92 to the front of the crankcase member 100.

Each throttle valve assembly 130 preferably includes a throttle body 131 and a throttle valve 132 disposed within the throttle body 131. The intake conduits 128 and the throttle bodies 129 preferably are made of aluminum alloy. In some arrangements, these components can be made of plastic. Preferably, the throttle valves 132 are butterfly valves that have valve shafts 133 journaled for pivotal movement about a generally vertical axis. In some arrangements, the valve shafts 133 are linked together and are connected to a control linkage. The control linkage would be connected to an operational member, such as a throttle lever, that is provided on the watercraft or otherwise proximate the operator of the watercraft. The operator can control the opening degree of the throttle valves 132 in accordance with operator demand through the control linkage. That is, the throttle valve assemblies 130 can measure or regulate amounts of air that flow through the intake passages 116 to the combustion chambers 96 in response to the operation of the operational member by the operator. Normally, the greater the opening degree, the higher the rate of airflow and the higher the engine speed.

The respective plenum chambers 118 preferably are defined with plenum chamber units or voluminous units 134 which are disposed side by side in front of the crankcase member 100. Preferably, the plenum chambers 134 are arranged substantially symmetrically relative to the longitudinal center plane 88. In the illustrated arrangement, each forward end portion 136 of the intake conduits 128 is housed within each plenum chamber unit 134. As illustrated in FIG. 3, each plenum chamber unit 134 preferably has two air inlets 138, which extend generally rearwardly between the respective intake conduits 128. That is, two of the intake conduits 128 are formed with one inlet 138 extending therebetween. The respective air inlets 138 define inlet openings 140 through which air is drawn into the plenum chambers 118. The plenum chamber units 134 also have other two openings 142 which are defined on another side and which are spaced apart vertically from one another. The openings 142 of one plenum chamber unit 134 preferably are formed opposite to the openings 142 of the other plenum chamber unit 134 and are coupled with each other by balancer pipes 144. Advantageously, this construction provides a manner of roughly equalizing the pressures within each chamber unit 134. The plenum chambers 118 coordinate air delivered to each intake passage 116 and also act as silencers to reduce intake noise. In other words, the chambers 118 act to reduce the pulsation energy within the intake system and to smooth the airflow being introduced to the engine. The air in both of the chambers 118 also is coordinated with one another through the balancer pipes 144. The plenum chamber units 134 and the balancer pipes 144 preferably are made of plastic, although they can of course be made of metal material such as, for example, aluminum alloy.

The air within the closed cavity 68 is drawn into the plenum chambers 118 through the inlet openings 140 as indicated by the arrows 148 of FIGS. 2 and 3. The air expands within the plenum chambers 118 to reduce pulsations and then enters the outer intake passages 116 through the end portions 136, as indicated by the arrows 150 of FIG. 2. The air passes through the outer intake passages 116 and flows into the inner intake passages 120 as indicated by the arrows 152, 154 of FIG. 2. As described, the level of airflow is measured by the throttle valve assemblies 130 before the air enters the inner intake passages 120.

The induction system 114 can include an idle air delivery mechanism that delivers idle air to the combustion chambers 96 under the condition such that, for example, the throttle valves 132 are substantially closed. The delivery mechanism can be connected to the air intake passages 116 downstream the throttle valve assemblies 130 as set forth in U.S. Pat. No. 6,543,429, issued Apr. 8, 2003, the entire contents of which is hereby expressly incorporated by reference. Otherwise, the idle delivery mechanism can bypass the throttle valve assemblies 130. That is, air to the idle delivery mechanism is drawn from the intake passages 116 at a location upstream the throttle valve assemblies 130 as disclosed, for example, in U.S. Pat. No. 6,015,319. In both arrangements, the idle delivery mechanism preferably has an idle speed control (ISC) valve operating under control of an electronic control unit (ECU) 158, which will be described later.

The engine 32 also includes an exhaust system that routes burnt charges, i.e., exhaust gases, to a location outside of the outboard motor 30. Each cylinder head assembly 92 defines a set of inner exhaust passages 162 that communicate with the combustion chambers 96 through one or more exhaust ports 164, which may be defined at the inner surfaces of the respective cylinder head assemblies 92. The exhaust ports 164 can be selectively opened and closed by exhaust valves 166. The construction of each exhaust valve and the arrangement of the exhaust valves are substantially the same as the intake valve and the arrangement thereof, respectively. Thus, further description of these components is deemed unnecessary.

Exhaust manifolds 168 preferably are defined generally vertically within the cylinder block 84 between the cylinder bores 86 of both the cylinder banks B1, B2. The exhaust manifolds 168 communicate with the combustion chambers 96 through the inner exhaust passages 162 and the exhaust ports 164 to collect exhaust gases therefrom. The exhaust manifolds 168 are coupled with the exhaust discharge passage of the exhaust guide member 80. When the exhaust ports 164 are opened, the combustion chambers 96 communicate with the exhaust discharge passage through the exhaust manifolds 168.

A valve cam mechanism preferably is provided for actuating the intake and exhaust valves 124, 166 in each cylinder bank B1, B2. Preferably, the valve cam mechanism includes one or more camshafts per cylinder bank, which camshafts extend generally vertically and are journaled for rotation relative to the cylinder head assemblies 92. The camshafts have cam lobes to push valve lifters that are affixed to the respective ends of the intake and exhaust valves 124, 166 in any suitable manner. The cam lobes repeatedly push the valve lifters in a timed manner, which is in proportion to the engine speed. The movement of the lifters generally is timed by rotation of the camshafts to appropriately actuate the intake and exhaust valves 124, 166.

A camshaft drive mechanism (not shown) preferably is provided for driving the valve cam mechanism. Thus, the intake and exhaust camshafts comprise intake and exhaust driven sprockets positioned atop the intake and exhaust camshafts, respectively, while the crankshaft 104 has a drive sprocket positioned atop thereof. A timing chain or belt is wound around the driven sprockets and the drive sprocket. The crankshaft 104 thus drives the respective camshafts through the timing chain in the timed relationship. Because the camshafts must rotate at half of the speed of the rotation of the crankshaft 104 in a four-cycle engine, a diameter of the driven sprockets is twice as large as a diameter of the drive sprocket.

The engine 32 preferably has indirect, port or intake passage fuel injection. The fuel injection system preferably comprises six fuel injectors 170 with one fuel injector allotted for each one of the respective combustion chambers 96. The fuel injectors 170 preferably are mounted on the throttle bodies 131 and a pair of fuel rails connects the respective fuel injectors 170 with each other on each cylinder bank B1, B2. The fuel rails also define portions of the fuel conduits to deliver fuel to the injectors 170.

Each fuel injector 170 preferably has an injection nozzle directed downstream within the associated intake passage 116, which is downstream of the throttle valve assembly 130. The fuel injectors 170 spray fuel into the intake passages 130, as indicated by the arrows 171 of FIG. 2, under control of an electronic control unit (ECU) 172. Control signals of the fuel injectors 170 are transmitted to the fuel injectors 170 from the ECU 158 through control lines 174. The ECU 158 controls both the initiation timing and the duration of the fuel injection cycle of the fuel injectors 170 so that the nozzles spray a proper amount of fuel each combustion cycle.

The ECU 158 preferably is disposed between a forward surface of the crankcase member 100 and the plenum chamber unit 134 on the port side, and preferably is mounted on the forward surface of the crankcase member 100. Air is drawn over the ECU 158 to help cool the ECU during operation of the engine.

Typically, a fuel supply tank disposed on a hull of the associated watercraft 40 contains the fuel. The fuel is delivered to the fuel rails through the fuel conduits and at least one fuel pump, which is arranged along the conduits. The fuel pump pressurizes the fuel to the fuel rails and finally to the fuel injectors 170. A vapor separator 176 preferably is disposed along the conduits to separate vapor from the fuel and can be mounted on the engine body 110 at the side surface on the port side. The fuel injection system and the vapor separator are disclosed, for example, in U.S. Pat. Nos. 5,873,347, 5,915,363 and 5,924,409, the disclosures of which are hereby incorporated by reference. It should be noted that a direct fuel injection system that sprays fuel directly into the combustion chambers can replace the indirect fuel injection system described above. Moreover, other charge forming devices, such as carburetors, can be used instead of the fuel injection systems.

The engine 32 further comprises an ignition or firing system. Each combustion chamber 96 is provided with a spark plug which preferably is disposed between the intake and exhaust valves 124, 166. Each spark plug has electrodes that are exposed into the associated combustion chamber 96 and that are spaced apart from each other with a small gap. The spark plugs are connected to the ECU 158 through appropriate control lines and an ignition device, such as ignition coils 178, are provided such that ignition timing is controlled by the ECU 158. The spark plugs generate a spark between the electrodes to ignite an air/fuel charge in the combustion chamber 96 at selected ignition timing under control of the ECU 158.

While the illustrated arrangement features hard-wired sensors and components, the signals can be sent through emitter and detector pairs, infrared radiation, radio waves or the like. The type of signal and the type of connection can be varied between sensors or the same type can be used with all sensors.

In the illustrated engine 32, the pistons 90 reciprocate between top dead center and bottom dead center. When the crankshaft 104 makes two rotations, the pistons 90 generally move from the top dead center position to the bottom dead center position (the intake stroke), from the bottom dead center position to the top dead center position (the compression stroke), from the top dead center position to the bottom dead center position (the power stroke) and from the bottom dead center position to the top dead center position (the exhaust stroke). During the four strokes of the pistons 90, the camshafts make one rotation and actuate the intake and exhaust valves 124, 166 to open the intake and exhaust ports 122, 164 during the intake stroke and the exhaust stroke, respectively.

Generally, during the intake stroke, air is drawn into the combustion chambers 96 through the air intake passages 116 and fuel is injected into the intake passages 116 by the fuel injectors 170. The air and the fuel thus are mixed to form the air/fuel charge in the combustion chambers 96. Slightly before or during the power stroke, the respective spark plugs ignite the compressed air/fuel charge in the respective combustion chambers 96. The air/fuel charge thus rapidly burns during the power stroke to move the pistons 90. The burnt charge, i.e., exhaust gases, then are discharged from the combustion chambers 96 during the exhaust stroke.

The engine 32 may comprise a cooling system, a lubrication system and other systems, mechanisms or devices other than the systems described above.

A flywheel assembly 180 preferably is positioned above atop the crankshaft 104 and is mounted for rotation with the crankshaft 104. The flywheel assembly 180 comprises a flywheel magneto or AC generator that supplies electric power to various electrical components, such as the fuel injection system, the ignition system and the ECU 158.

With reference again to FIG. 1, the driveshaft housing 62 depends from the power head 58 to support a driveshaft 184 which is coupled with the crankshaft 104 and which extends generally vertically through the driveshaft housing 62. The driveshaft 184 is journaled for rotation and is driven by the crankshaft 104. The driveshaft housing 62 preferably defines an internal section 186 of the exhaust system that leads the majority of exhaust gases to the lower unit 64. The internal section 186 includes an idle discharge portion that is branched off from a main portion of the internal section 186 to discharge idle exhaust gases directly out to the atmosphere through a discharge port that is formed on a rear surface of the driveshaft housing 62 in idle speed of the engine 32. The exhaust internal section 186 is schematically shown in FIG. 1 to include a portion of the exhaust manifolds 168 and the exhaust discharge passage.

The lower unit 64 depends from the driveshaft housing 62 and supports a propulsion shaft 188 that is driven by the driveshaft 184. The propulsion shaft 188 extends generally horizontally through the lower unit 64 and is journaled for rotation. A propulsion device is attached to the propulsion shaft 188. In the illustrated arrangement, the propulsion device is a propeller 190 that is affixed to an outer end of the propulsion shaft 188. The propulsion device, however, can take the form of a dual counter-rotating system, a hydrodynamic jet, or any of a number of other suitable propulsion devices.

A transmission 192 preferably is provided between the driveshaft 184 and the propulsion shaft 188, which lie generally normal to each other (i.e., at a 90° shaft angle) to couple together the two shafts 184, 188 by bevel gears. The outboard motor 30 has a clutch mechanism that allows the transmission 192 to change the rotational direction of the propeller 190 among forward, neutral or reverse.

The lower unit 64 also defines an internal section of the exhaust system that is connected with the internal exhaust section 186 of the driveshaft housing 62. At engine speeds above idle, the exhaust gases generally are discharged to the body of water surrounding the outboard motor 30 through the internal sections and then a discharge section defined within the hub of the propeller 190. Incidentally, the exhaust system can include a catalytic device at any location in the exhaust system to purify the exhaust gases.

With reference still to FIG. 2, a control system 200 including the ECU 158 and a variety of control wires (e.g., the control wires 174 of the fuel injectors 170) will now be described. Additionally, the control system 200 comprises a variety of sensors that communicate with the ECU 158 in any suitable manner.

In the illustrated embodiment, a crankshaft angle position sensor 202 preferably is provided proximate the crankshaft 104. The angle position sensor 202, when measuring crankshaft angle versus time, outputs a crankshaft rotational speed signal or engine speed signal that is sent to the ECU 158 through a sensor signal line or wire 204. In one arrangement, the angle position sensor 202 comprises a pulsar coil positioned adjacent to the crankshaft 104 and a projection or cut formed on the crankshaft 104. The pulsar coil generates a pulse when the projection or cut passes proximate the pulsar coil. In some arrangements, the number of pulses can be counted. The angle position sensor 202 thus can sense not only a specific crankshaft angle but also a rotational speed of the crankshaft 104, i.e., engine speed. Of course, other types of speed sensors also can be used and such speed sensors can be suitably positioned depending upon the application.

An air intake pressure sensor 208 preferably is positioned atop the uppermost throttle assembly 130 for the intake passage 116 of the cylinder bank B1 on the port side. The intake pressure sensor 208 senses the intake pressure in this passage 116 during engine operation. The sensed signal is sent to the ECU 158 through a sensor signal line or wire 210. The illustrated signal line 210 extends in a space 212 defined by the side surface of the engine body 110 on the port side and the intake conduit 128 of the cylinder bank B1. The signal line 210 can lie either above or below the vapor separator 176. A rack, for example, extending from the engine body 110 or the intake conduit 128 preferably supports the wire 210. This signal can be used for determining the operator's demand or engine load. Of course, other suitable sensors and mounting positions also can be used.

A throttle valve position sensor 216 preferably is provided atop of and proximate the valve shaft assembly 133 of the throttle assembly 130 for the intake passage 116 of the cylinder bank B2 on the starboard side. The throttle valve position sensor 216 senses an opening degree or opening position of the throttle valves 132 on this side. A sensed signal is sent to the ECU 158 through a sensor signal line or wire 218. This signal can also be used for determining the operator's demand or engine load. The illustrated signal line 218 extends over the cylinder block 84 and further extends in the space 212 and can lie either above or below the vapor separator 176. Another rack or the foregoing rack can also support the wire 218. Alternatively, the signal line 218 can extend in a space 220 defined by the side surface of the engine body 110 on the starboard side and the intake conduit 128 of the cylinder bank B2 and also by the forward surface of the engine body 110 and the plenum chamber unit 134 for the intake conduit 128 on the starboard side. This arrangement is advantageous because simultaneous snapping risks of both the wires 210 218 can be greatly reduced in the event one side of the power head 58 is damaged.

The operator's demand or engine load, as determined by the throttle opening degree, is sensed by the throttle position sensor 216. Generally, in proportion to the change of the throttle opening degree, the intake air pressure also varies and is sensed by the intake pressure sensor 208. The throttle valve 132 is opened through the use of an operator control (i.e., throttle lever) to increase the speed of the watercraft. When the throttle valve opening is widened toward a certain position when compared with the previous position, more air is induced into the combustion chambers 96 through the intake passages 116. The intake pressure simultaneously increases at this moment. The engine load can also increase when the associated watercraft 40 advances against wind. In this situation, the operator also operates the throttle lever to recover the speed that may be lost.

Other sensors can be provided to sense the intake air conditions of the engine 32. For instance, a type of sensor that directly senses the air amount is applicable, such as moving vane types, heat wire types and Karman Vortex types of air flow meters. Such a type of sensor can replace both or either one of the intake pressure sensor 208 and/or the throttle valve position sensor 216.

The signal lines preferably are configured with hard-wires or wire-harnesses. In some aspects of the present invention, however, the signals can be sent through emitter and detector pairs, infrared radiation, radio waves or the like. The type of signal and the type of connection can be varied between sensors or the same type can be used with all sensors.

Still other sensors that sense other engine running conditions and/or ambient conditions of the engine or outboard motor can be used. For example, an intake air temperature sensor, an engine temperature sensor, an oxygen ($O_2$) sensor, a trim angle sensor and a back pressure sensor are all applicable.

The ECU 158 can be designed as a feedback control system using the signals of the various sensors. The ECU 158 preferably has various control maps which typically employ parameters such as, for example, the engine speed, the intake pressure and the throttle valve position that are sent from the sensors to determine an optimum control condition at every moment and then controls the fuel injection system, the ignition system and other actuators, if any, in accordance with the determined control condition.

The signals of both the intake pressure sensor 208 and the throttle position sensor 216 indicate different aspects of the same intake air condition. Although any control strategy can be applied, in the illustrated embodiment, while the signal of the intake pressure sensor 208 primarily is used for determining an amount of the injected fuel with the engine speed signal, the signal of the throttle valve position sensor 216 primarily is used for increasing or decreasing the injected fuel amount in response to the acceleration demand or deceleration demand, respectively. It should be noted that, if the intake pressure sensor or the throttle valve position sensor (or the air flow meter, if any) on one side is normal, a minimum control by the ECU can be done because all of the signals from the sensors can represent generally the same intake air condition.

As thus described, in the illustrated embodiment, the intake pressure sensor and the throttle valve position sensor are disposed on different sides of the engine relative to each other. This arrangement thus can decrease possibility of impact damage to all of the sensors that sense a condition of intake air. Also, the arrangement increases the amount of maintenance working space per sensor. Furthermore, if the wires that connect the sensors to the ECU are disposed at different locations as indicated in the alternative, the risk of both wire connections being severed at once is greatly be reduced. In addition, the illustrated sensors are positioned atop both the intake conduits. This arrangement is quite suitable for the outboard motor because the positions also are almost the farthest location from the water surface 42 and hence the risk of water splashing onto the sensors can be greatly reduced.

Of course, the foregoing description is that of a preferred construction having certain features, aspects and advantages in accordance with the present invention. Various changes and modifications may be made to the above-described arrangements without departing from the spirit and scope of the invention, as defined by the appended claims.

What is claimed is:

1. An internal combustion engine comprising a cylinder block defining first and second banks of cylinder bores extending separately from each other, pistons reciprocating within the respective cylinder bores, cylinder head members arranged to close respective ends of the first and second banks of the cylinder bores, the cylinder head members defining combustion chambers together with the cylinder bores and the pistons, an air induction system arranged to introduce air to the combustion chambers, the induction system including first and second intake units with the first intake unit allotted to the first cylinder bank and with the second intake unit allotted to the second cylinder bank, the first and second intake units defining first and second intake passages, respectively, through which the air flows, fuel injectors arranged to spray fuel for combustion in the combustion chambers, first and second sensors arranged to sense a condition of the air flowing in the induction system, and a control device configured to control the fuel injectors based upon signals of the first and second sensors, the first sensor being disposed at the first intake unit, and the second sensor being disposed at the second intake unit such that only the first sensor is used to sense a condition of the air flow in the first intake passage and only the second sensor is used to sense a condition of the air flow in the second intake passage, the first sensor being of a different type than the second sensor so as to sense a different air flow condition through the induction system than the air flow condition sensed by the second sensor and different from any other air flow sensor in the second intake passage.

2. The engine as set forth in claim 1, wherein one of the first and second sensors is configured to sense intake air pressure in the intake passage associated with the sensor.

3. The engine as set forth in claim 1, wherein each one of the first and second intake units includes a throttle valve arranged to regulate an amount of the air flowing through the associated intake passage, and one of the first and second sensors is configured to sense an opening degree of the associated throttle valve.

4. The engine as set forth in claim 1, wherein the first cylinder bank includes at least two cylinder bores, the first intake unit comprises at least two intake conduits corresponding to the two cylinder bores, and the first sensor is disposed along one of the intake conduits.

5. The engine as set forth in claim 4, wherein the second cylinder bank includes at least two cylinder bores, the second intake unit comprises at least two second intake conduits corresponding to the two cylinder bores of the second cylinder bank, and the second sensor is disposed along one of the intake conduits of the second intake unit.

6. The engine as set forth in claim 1, wherein the first and second cylinder banks of the cylinder bores together form a V-configuration.

7. The engine as set forth in claim 6, wherein the first sensor is connected to the control device with a first electrical line extending generally on a first side of the cylinder block, the second sensor is connected to the control device with a second electrical line extending generally on a second side of the cylinder block, and the second side is located generally opposite to the first side relative to the cylinder block.

8. The engine as set forth in claim 7, wherein the control device is positioned generally opposite to the cylinder head members.

9. The engine as set forth in claim 8, wherein the first intake unit at least in part extends along the first surface of the cylinder block and the second intake unit at least in part extends along the second surface of the cylinder block.

10. The engine as set forth in claim 1, wherein the first and second cylinder banks are disposed along a pair of generally vertical planes, and the first and second sensors are positioned atop the first and second intake units, respectively.

11. The engine as set forth in claim 10, wherein each one of the first and second cylinder banks includes at least two cylinder bores spaced generally vertically from each other, the first and second intake units extends generally horizontally, each one of the first and second intake units comprising at least two intake conduits spaced generally vertically from each other, and the first and second sensors are coupled with the respective uppermost intake conduits.

12. The engine as set forth in claim 1, wherein the engine operates on a four-cycle combustion principle.

13. The engine as set forth in claim 1, wherein the engine powers a marine propulsion device.

14. An outboard motor comprising an internal combustion engine, a support member arranged to support the engine, the engine including an engine body, at least two moveable members moveable relative to the engine body, the engine body and the moveable members together defining at least two combustion chambers, an air induction system arranged to introduce air to the combustion chambers, the induction system including first and second intake units delivering the air to the respective combustion chambers, at least one electrical device relating to the operation of the engine, first and second sensors arranged to sense a condition of the intake air, and a control device configured to control the electrical device based upon signals of the first and second sensors, the first sensor being disposed at the first intake unit and configured to sense a first condition of the air flow through the first intake unit, and the second sensor being disposed at the second intake and configured to sense a second condition of the air flow through the second intake unit, the first and second conditions being different from each other, and wherein only the first sensor is used to sense an air flow condition of the air flow through the first intake units, and only the second sensor is used to sense an air flow condition of the air flow in the second intake unit.

15. The outboard motor as set forth in claim 14, wherein the engine body and the moveable members together define at least three combustion chambers with two of the combustion chambers communicating with the first intake unit, the first intake unit comprises at least two intake conduits extending generally horizontally and spaced apart generally vertically from each other, and the first sensor is disposed atop the uppermost intake conduit.

16. The outboard motor as set forth in claim 15, wherein the engine body and the moveable members together define at least one more combustion chamber so that two of the combustion chambers communicating with the second intake unit, the second intake unit comprises at least two intake conduits extending generally horizontally and spaced apart generally vertically from each other, and the second sensor is disposed atop the uppermost intake conduit of the second intake unit.

17. The outboard motor as set forth in claim 14 additionally comprising an air temperature sensor communicating with the control device.

18. The engine as set forth in claim 1 additionally comprising an air temperature sensor communicating with the control device.

19. An internal combustion engine comprising an engine body that has first and second banks, the first bank defining a first combustion chamber, the second bank defining a second combustion chamber, a first intake passage arranged to deliver air to the first combustion chamber, a second intake passage arranged to deliver air to the second combustion chamber, a single air pressure sensor, a single air flow sensor, and a controller configured to receive outputs of the sensors, the pressure air sensor being arranged to detect an intake pressure within the first intake passage, and the air flow sensor being arranged to detect an amount of air flow through the second intake passage, wherein no other sensors are used to sense air flow conditions in the first and second passages.

20. The engine as set forth in claim 19, wherein the control device is configured to use both the outputs of the pressure sensor and air flow sensor to control an operation of the engine under a normal operational condition of the engine.

21. The engine as set forth in claim 20, wherein the control device is configured to use either the output of the pressure sensor or the output of the air flow sensor, whichever is functional, under an abnormal operational condition of the engine.

22. The engine as set forth in claim 19, wherein at least the second intake passage having an air flow regulating device that regulates an amount of air flowing through the second intake passage, and the second sensor senses a position of the regulating device.

23. The engine as set forth in claim 19, wherein the first and second intake passages are disposed on generally opposite sides of the engine.

* * * * *